United States Patent [19]

Edmonston

[11] 3,985,839

[45] Oct. 12, 1976

[54] CARBURETOR

[75] Inventor: William H. Edmonston, Lake Isabella, Calif.

[73] Assignee: Lectron Products, Inc., Troy, Mich.

[22] Filed: May 30, 1975

[21] Appl. No.: 582,392

Related U.S. Application Data

[63] Continuation-in-part of Ser. No. 563,594, March 31, 1975.

[52] U.S. Cl. ..... 261/44 R; 261/DIG. 38; 251/DIG. 4

[51] Int. Cl.[2] ..... F02M 9/06

[58] Field of Search ..... 251/DIG. 4; 261/44 R, 261/50 A, DIG. 38

[56] References Cited

UNITED STATES PATENTS

| | | | |
|---|---|---|---|
| 1,010,184 | 11/1911 | Schulz | 261/50 A |
| 1,305,036 | 5/1919 | Vincent | 261/44 R |
| 1,849,317 | 3/1932 | Schoeller | 261/50 A |
| 2,203,858 | 6/1940 | Booty | 261/50 A |
| 2,574,670 | 11/1951 | Sweeney | 261/50 A |
| 3,841,281 | 10/1974 | Mick | 261/44 R |

FOREIGN PATENTS OR APPLICATIONS

| | | | |
|---|---|---|---|
| 579,125 | 7/1924 | France | 261/44 R |
| 144,680 | 7/1921 | United Kingdom | 261/50 A |

*Primary Examiner*—Tim R. Miles
*Attorney, Agent, or Firm*—Harness, Dickey & Pierce

[57] ABSTRACT

A carburetor of the slide and pin type having a throttle slide carrying a pin extending into a fuel discharge nozzle tube. The pin is tapered and has a shoulder at the deeper end of the taper which acts as an acceleraor pump, providing a spurt of fuel under conditions of rapid acceleration. The pump structure also provides support for the outboard end of the pin. A novel pin taper construction is also shown which furnishes increased atomization.

5 Claims, 8 Drawing Figures

Fig. 3.
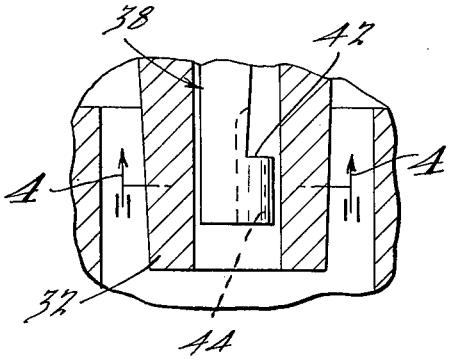
Fig. 4.
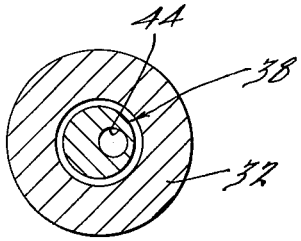
Fig. 5.
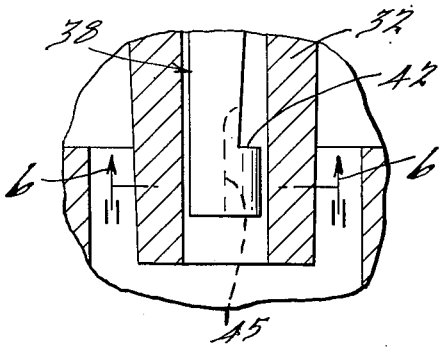
Fig. 6.
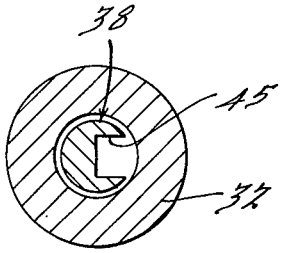
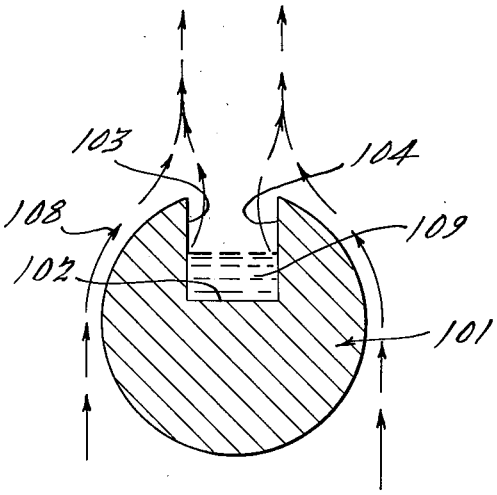
Fig. 7.
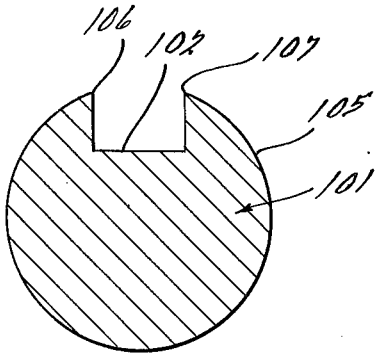
Fig. 8.

CARBURETOR

BACKGROUND OF THE INVENTION

The invention relates to carburetor constructions, and more particularly to carburetors of the type having a through passage for air and an adjustable throttle slide at an intermediate portion which varies the flow-through area and simultaneously adjusts the amount of fuel which enters the passage at that intermediate point and is mixed with the flowing air. More particularly, the invention is concerned with the construction of the metering rod or pin carried by the slide and disposed in the fuel nozzle tube.

BRIEF SUMMARY OF THE INVENTION

It is an object of the present invention to provide a novel and improved carburetor of the slide and pin which incorporates simple and reliable means for enriching the fuel-air mixture under conditions of rapid acceleration.

It is another object to provide an improved carburetor of this type in which support is provided for the outboard end of the pin, minimizing the possibility of vibration or pulsation of the pin which might tend to adversely affect the flow of fuel into the air passage, and consequently the air-fuel mixture, at certain harmonic frequencies.

It is another object to provide a carburetor of this type which incorporates a tapered pin of novel construction increasing the efficiency of atomization and the uniformity of air-fuel mixture.

Briefly, the invention comprises a carburetor having a body with inlet and outlet ends, a throat extending through said body from one end to the other, a throttle slide in said body extending transversely to said throat at an intermediate portion thereof, said slide being movable to vary the unblocked portion of said throat, a fuel tube extending transversely to said throat and having an opening into the throat a pin disposed in said tube and being tapered with the narrowest portion of said taper adjacent said opening, means for causing relative reciprocation between said pin and tube, and a shoulder on said pin adjacent the widest end of said taper, whereby movement of said shoulder toward said opening will cause the shoulder to create a pumping action on the fuel in said tube and thereby increase the flow of fuel into said throat.

In another aspect, the invention comprises a carburetor having a body with inlet and outlet ends, a throat extending through said body from one end to the other, a throttle slide in said body extending transversely to said throat at an intermediate portion thereof, said slide being movable to vary the unblocked portion of said throat, a fuel tube extending transversely to said throat and having an opening into the throat, and a pin disposed in said tube and secured at one end to said slide, said pin being of generally cylindrical shape but having a taper on the downstream side, the width of said taper being substantially narrower than the diameter of said pin, whereby said taper will form a groove in said pin of varying depth, the groove having shoulders on opposite sides formed by said pin, said shoulders having relatively sharp edges, whereby air flowing past said edges will draw fuel from said groove and finely atomize said fuel.

In still another aspect, the invention comprises a metering pin for use in a carburetor of the type having a throat and a fuel tube opening onto said throat and receiving said pin, comprising a cylindrical member, and a taper on one side of said pin, the width of siad taper being substantially narrower than the diameter of said pin, said taper being relatively deep whereby the taper will form a groove in said pin of varying depth, the groove having shoulders on opposite sides formed by said pin, said shoulders having relatively sharp edges, whereby air flowing past said edges will draw fuel from said groove and finely atomize said fuel.

BRIEF DESCRIPTION OF THE DRAWINGS

FIG. 3 is an enlarged fragmentary cross-sectional view in elevation taken in the vicinity of the lower end of the pin;

FIG. 4 is a bottom cross-sectional plan view taken along the line 4—4 of FIG. 3;

FIG. 5 is similar to FIG. 3 but showing a different type of construction for the pin bottom;

FIG. 6 is a bottom cross-sectional plan view taken along the line 6—6 of FIG. 5;

FIG. 7 is a cross-sectional view of a modified form of pin in which the taper is substantially narrower than the pin diameter and forms a shouldered groove; and FIG. 8 is a view similar to FIG. 7 but taken at a shallower portion of the groove.

DESCRIPTION OF THE PREFERRED EMBODIMENTS

Figure 1:
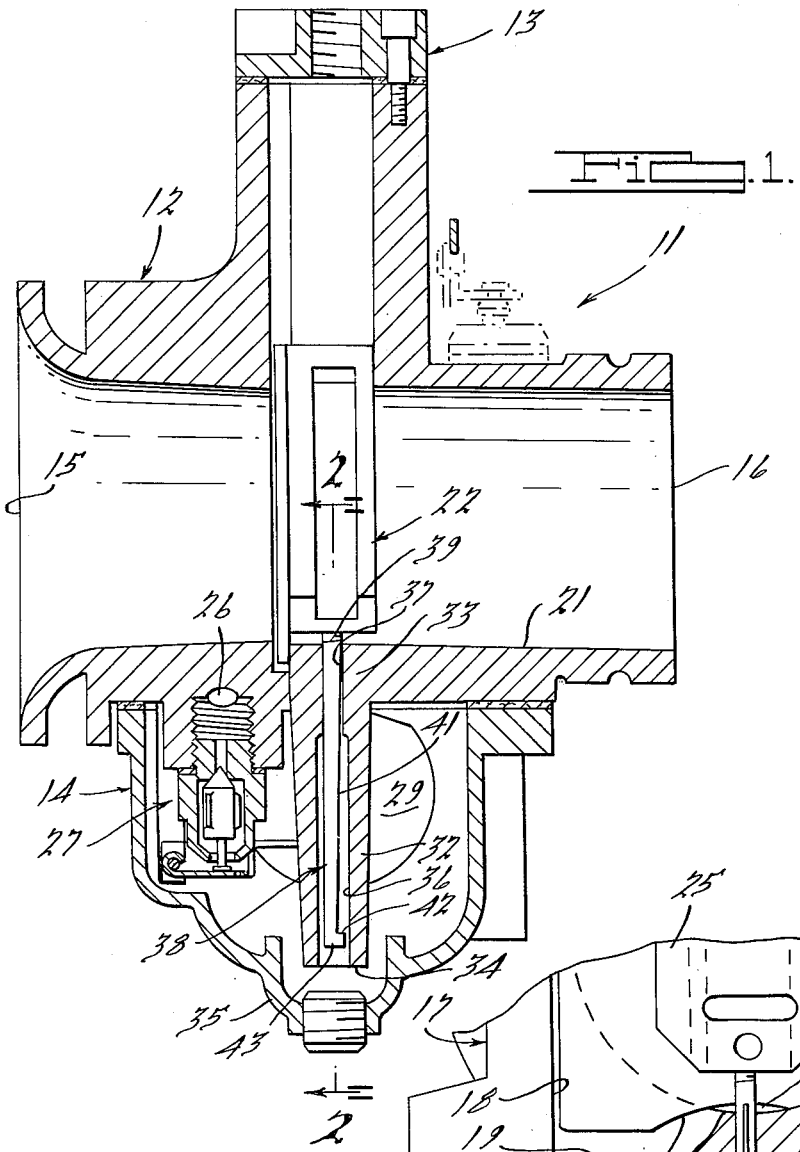
FIG. 1 is a cross-sectional view in elevation of a carburetor incorporating the principles of this invention.

The carburetor is generally indicated at 11 and comprises a body generally indicated at 12, a cover 13 above the body and a bowl 14 secured to the underside of the body. Body 12 is of elongated shape, having an inlet end 15 and an outlet end 16, both ends being open. A slide supporting portion generally indicated at 17 is formed on body 12 intermediate ends 15 and 16 and extends thereabove. Suitably, body 12 may be fabricated of two parts having abutting surfaces at slide supporting portions 17.

Figure 2:
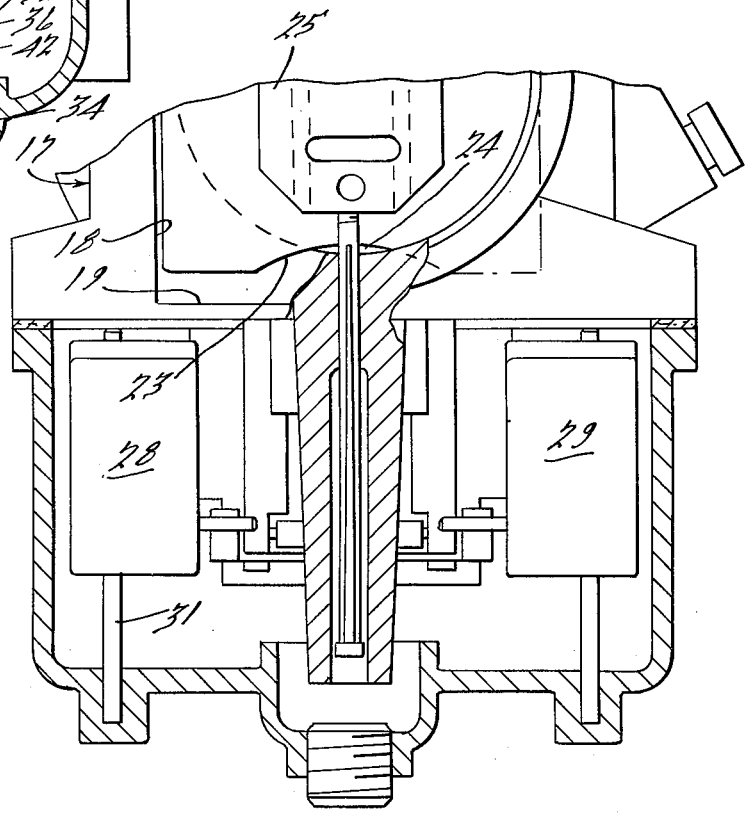
FIG. 2 is a partial cross-sectional view in elevation taken along the line 2—2 of FIG. 1.

The slide supporting portion is provided with a pair of facing grooves 18 and a connecting bottom groove 19 open to the carburetor throat, which is indicated at 21. A throttle slide generally indicated at 22 is mounted in these grooves and is vertically adjustable to vary the unblocked portion of throat 21. The width of slide 22 is slightly greater than that of intermediate portion throat 21, and the slide has a generally rectangular shape as seen partially in FIG. 2. A concave arcuate recess 23 is centrally formed along the lower or control edge of slide 22. Means (not shown) is provided for limiting the downward movement of slide 22, thus defining the idle position. This position may be chosen so that a slight gap 24 exists between the central portion of recess 23 and the bottom of throat 21. Alternatively, for purposes such as racing, the setting may be for complete shutoff at idle, the recess 23 being within slot 19.

Slide 22 is quite thin but has a central enlargement 25 on its downstream side which extends from the top of the slide toward recess 23. Means shown more particularly in the aforementioned copending application is provided for vertically adjusting slide 22.

Bowl 14 is provided with a fuel inlet passage 26 leading to a float needle valve generally indicated at 27. This valve is controlled by a pair of floats 28 and 29 guided by pins 31 within the bowl. THe arrangement is such that floats 28 and 29, when lifted by the rising level of fuel in bowl 14, will close valve 27, thus controlling the level of fuel in the bowl.

A fuel discharge nozzle tube 32 extends downwardly from the lower portion of body 12 into bowl 14. The exterior of tube 32 tapers downwardly from its juncture 33 with the body, and bottom 34 of the tube is disposed within the cup-shaped portion 35 of bowl 14. A relatively wide channel 36 within the tube leads upwardly to a narrow nozzle pin guide passage 37, the latter opening onto and being flush with carburetor throat 21.

A metering rod or nozzle pin generally indicated at 38 is secured to extension 25 of slide 22 and extends downwardly into nozzle tube 32. The upper end of pin 38 is mounted in extension 25 by means disclosed more particularly in the aforementioned copending application as well as in the copending application of Norman G. Quantz, Ser. No. 578,265, filed May 16, 1975, assigned to the assignee of the present application. The mounting means permits vertical adjustment of the pin with respect to the slide in order to obtain the desired richness of mixture at various settings, and also allows float in the nature of a universal joint to compensate for tolerance variations in the nozzle pin guide means.

Below its upper mounting portion, pin 38 is provided with a cylindrical upper portion 39 and a flat taper 41 therebelow extending to a radial shoulder 42 near the bottom. The portion 43 of pin 38 below shoulder 42 is cylindrical and of the same diameter as upper portion 39. The diameter of the entire pin between portions 39 and 43 is constant, except for taper 41. The depth of taper 41 will affect performance at higher speeds, deeper tapers resulting in richer fuel-air mixtures. Raising the pin relative to slide recess 23 will also enrich the mixture at a given slide setting.

The fit between portion 39 of the pin and bore portion 37 is very close, perhaps 0.001 inches or less. In the normal idle position, this cylindrical pin portion is slightly above bore portion 37. For fuel shutoff in racing applications, however, the cylindrical pin portion may extend slightly into bore portion 37. If slide recess 23 is within groove 19, complete air and fuel shutoff will result.

When in idle position, the bottom 43 of pin 38 will be slightly above the bottom 34 of tube 32, there being considerably more tolerance between the pin and bore portion 36 than with bore portion 37. During sudden acceleration, when slide 22 is raised quickly, shoulder 42 may have a pumping action on the fuel within bore portion 36, thus increasing fuel flow to the carburetor throat. This will result in a richer fuel-air mixture under conditions of rapid acceleration. Portion 43 of the pump also provides support for the outboard end of pin 38, thus coacting with the aforementioned mounting means for the pin to minimize vibration or pulsation of the pin which, particularly at certain harmonic frequencies, could adversely affect the flow of fuel into the air passage and consequently the fuel-air mixture.

FIGS. 3 to 6 show two manners in which fuel may pass from the bottom of pin 38 into the space between its tapered surface 41 and the inner tube wall. In FIGS. 3 and 4, a drilled hole 44 extends from the bottom of pin 38 to shoulder 42. In FIGS. 5 and 6, a milled slot 45 is provided in place of hole 44.

In operation, air will flow into entrance 15 of throat 21 and past that portion of pin 38 which is lifted by slide 22 into the airstream. The movement of air past the pin will cause a zone of reduced pressure adjacent flat tapered downstream surface 41, serving to draw the fuel from the float chamber and deliver it to the main air passage in finely divided, atomized particles.

FIGS. 7 and 8 illustrate another embodiment of the invention in which the pin, generally indicated at 101, has a tapered portion 102, but this tapered portion is considerably narrower than the pin diameter and is relatively deeper than the taper in the first embodiment. Thus, the tapered portion forms a groove having sides 103 and 104. These sides form, with the outer cylindrical surface 105 of pin 101, relatively sharp corners 106 and 107 respectively. Since taper 102 faces the downstream side of the pin, the air 108 rushing past corners 106 and 107 will draw the fuel 109 in the groove formed by taper 102 into the carburetor throat in finely divided, atomized particles. The construction shown in FIGS. 7 and 8, and particularly the sharp corners formed by this construction, are believed to create relatively greater atomization as well as a more uniform mixture. The possibility of obtaining "dirty air," that is, air with less finely divided fuel particles, is diminished as compared with a tapered pin in which the side edges of the tapered surface are more obtuse.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A carburetor comprising a body with inlet and outlet ends, a throat extending through said body from one end to the other, a throttle slide in said body extending transversely to said throat at an intermediate portion thereof, said slide being movable to vary the unblocked portion of said throat, a fuel tube extending transversely to said throat and having an opening into the throat, a pin disposed in said tube and being tapered with the narrowest portion of said taper adjacent said opening, means for causing relative reciprocation between said pin and tube, a shoulder integrally formed on said pin and extending substantially at right angles thereto from the widest end of said taper, whereby movement of said shoulder toward said opening will cause the shoulder to create a pumping action on the fuel in said tube and thereby increase the flow of fuel into said throat, and a passage extending from the adjacent end of said pin through said shoulder.

2. A carburetor according to claim 1, said passage comprising a drilled hole.

3. A carburetor according to claim 1, said passage comprising a milled slot.

4. A carburetor according to claim 1, said means for causing relative reciprocation between the tube and pin comprising means mounting the end of said pin remote from said shoulder on said slide.

5. A carburetor according to claim 1, said pin having a round cross section, said tapered surface being substantially narrower than the pin diameter and relatively deep whereby said tapered surface has shoulders formed on the opposite sides thereof, the shoulders comprising two substantially parallel surfaces, the outer surface of said pin and said shoulders forming relatively sharp edges.

* * * * *